US007121705B2

(12) United States Patent
Albou et al.

(10) Patent No.: US 7,121,705 B2
(45) Date of Patent: Oct. 17, 2006

(54) HEADLIGHT FOR A MOTOR VEHICLE COMPRISING A REFLECTOR AND AN OPTICAL DEVIATION ELEMENT

(75) Inventors: Pierre Albou, Bobigny (FR); Antoine de Lamberterie, Bobigny (FR); Vincent Godbillon, Bobigny (FR); Eric Moisy, Bobigny (FR)

(73) Assignee: Valeo Vision, Bobigny Cedex (FR)

( * ) Notice: Subject to any disclaimer, the term of this patent is extended or adjusted under 35 U.S.C. 154(b) by 91 days.

(21) Appl. No.: 10/877,281

(22) Filed: Jun. 25, 2004

(65) Prior Publication Data

US 2004/0264210 A1 Dec. 30, 2004

(30) Foreign Application Priority Data

Jun. 27, 2003 (FR) ..... 03 07760
Feb. 13, 2004 (FR) ..... 04 01497

(51) Int. Cl.
*F21V 7/00* (2006.01)

(52) U.S. Cl. ..... 362/517

(58) Field of Classification Search ..... 362/297, 362/346, 517, 518, 304, 302, 305, 328, 221
See application file for complete search history.

(56) References Cited

U.S. PATENT DOCUMENTS 4,087,682 A * 5/1978 Kolodziej ..... 362/297
5,582,480 A * 12/1996 Zwick et al. ..... 362/298
6,435,703 B1 8/2002 Takada
6,441,943 B1 * 8/2002 Roberts et al. ..... 359/267
6,499,870 B1 12/2002 Zwick et al.
6,908,207 B1 * 6/2005 Jeannot ..... 362/37
6,953,272 B1 * 10/2005 Hayakawa et al. ..... 362/517
2002/0186570 A1 12/2002 Albou et al.

FOREIGN PATENT DOCUMENTS

EP 1126210 A2 8/2001
EP 1126210 A3 8/2001
EP 1243846 A1 9/2002
EP 1302719 A1 4/2003
FR 2829225 3/2003

OTHER PUBLICATIONS

French Search Report dated Feb. 2, 2004.

* cited by examiner

*Primary Examiner*—Renee Luebke
*Assistant Examiner*—Julie A. Shallenberger
(74) *Attorney, Agent, or Firm*—Morgan & Finnegan, LLP

(57) ABSTRACT

Headlight for a motor vehicle comprising a reflector with an optical axis and at least one focus, a light source placed close to a focus of the reflector, and a transparent optical deviation element placed in front of part of the reflector, this element consisting of a module comprising a so-called "square lens" and the reflector placed behind the said lens, the module being able to provide an essentially horizontal spread of the light. The wall of the reflector comprises at least one scallop on one side of a plane passing through the optical axis of the reflector, and at least one additional reflector is disposed on the side of the scallop opposite to the optical axis, this additional reflector being designed to collect at least some of the light coming from the source emerging from the scallop, and to produce an additional beam which is not intercepted by the lens.

20 Claims, 7 Drawing Sheets

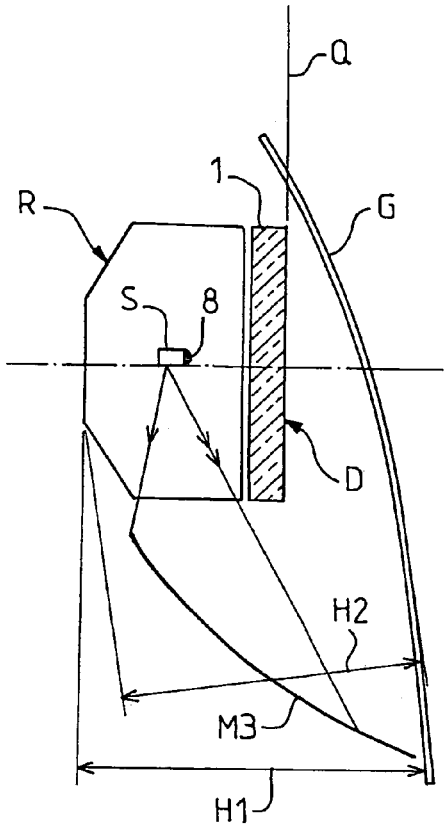
FIG.9
FIG.10
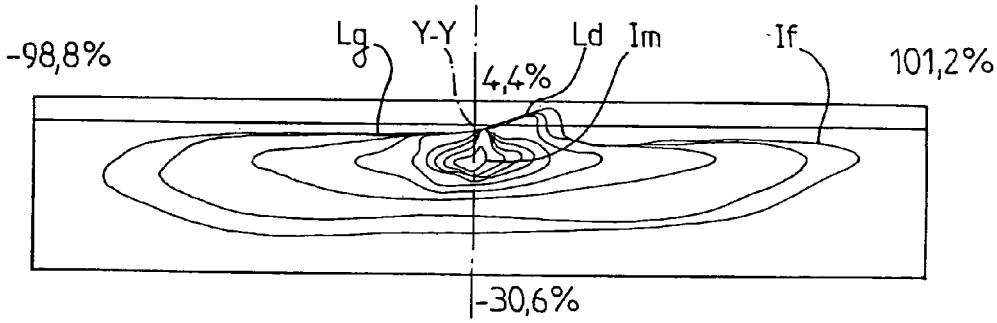

HEADLIGHT FOR A MOTOR VEHICLE COMPRISING A REFLECTOR AND AN OPTICAL DEVIATION ELEMENT

FIELD OF THE INVENTION

The invention relates to a headlight for a motor vehicle comprising: a reflector having an optical axis and at least one focus; a light source placed close to a focus of the reflector; and a transparent optical deviation element placed in front of part of the reflector, this element consisting of a module comprising a lens referred to as a "square lens" and a reflector placed behind the said lens, the module being able to provide an essentially horizontal spread of the light.

BACKGROUND OF THE INVENTION

The simplifying expression "square lens", for reasons of conciseness, is taken to mean in the context of the invention a lens which has at least one cylindrical face (input and/or output) with vertical generatrices. The contour of the lens is therefore not limited to the square shape, but may be rectangular, circular, oval, ovoid or ogival, or have a contour of the square or rectangular type but with rounded edges or bevels, or with any other contour.

A headlight comprising such a square lens is known from EP-A-1 243 846. This headlight has the advantage of a relatively shallow depth (that is to say dimension in the direction of the optical axis) and a high light flux. However, the range of the light beam is small. In addition, this headlight does not make it possible to easily produce a cut-off of the beam inclined to the horizontal, for example by 15°, in order to produce a dipped headlight.

The aim of the invention is in particular to provide a headlight which, whilst keeping a shallow depth and high light flux, makes it possible to obtain a long range of the beam and, if so desired, to produce a cut-off of the beam inclined to the horizontal, in particular for a dipped headlight function.

SUMMARY OF THE INVENTION

According to the invention, a headlight for a motor vehicle of the type defined above meets the following definition:

- the wall of the reflector comprises at least one scallop on one side of a plane passing through the optical axis of the reflector,
- and at least one additional reflector is disposed on the side of the scallop opposite to the optical axis, this additional reflector being provided for collecting at least part of the light coming from the source leaving through the scallop, and for producing an additional beam which is not substantially intercepted by the lens.

Advantageously, the wall of the reflector comprises at least one scallop on one side of a plane which is vertical, horizontal or oblique with respect to the vertical and passing through the said optical axis. The invention thus provides several embodiments, where the general orientation of the optical system associating the lamp, the reflectors and the scallops may be either vertical or horizontal, or take any desired orientation with respect to the vertical, here in particular to take into account aesthetic considerations or dimensional requirements related to the vehicle which will be equipped with the headlight in question.

The lamp used can be of the filament lamp type whose orientation may be axial, transverse or oblique. The optical axis cited above is therefore merged with the axis of the filament of the lamp when it is chosen with an axial orientation.

In the context of the invention, the spatial references used of the "vertical", "horizontal", "lateral" or "oblique" type are to be understood according to the positioning of the relevant elements of the headlight, once the headlight is mounted in the vehicle.

The square-lens module is advantageously adjusted in terms of total flux collected, with regard to its horizontal directing curve, for a given depth of the headlight and with the greatest focal length possible.

The square-lens module can also be adjusted in terms of total flux collected with regard to the height of its vertical cut-off, for a given depth of the headlight and with the longest focal length possible, in particular when the scallop or scallops are on one side of a vertical or oblique plane passing through the optical axis.

The height of the reflector and of the lens which faces it is preferably chosen so as to ensure the best possible collection of the light flux (for the focal length obtained when the vertical generatrix is optimised and having regard to the limit depth acceptable, this determines the height of the vertical cut-off of the reflector; this height is the highest of the square-lens module whose useful apparent surface then takes the appearance of an oval).

A horizontal parallel beam is not, or is substantially not, diverted vertically.

Preferably, the wall of the reflector (R) comprises two scallops (2, 3) situated on each side of a plane passing through the optical axis, at least one additional reflector (M2, M3) being associated with each scallop and disposed on the side of the scallop opposite to the optical axis in order to produce an additional beam which is not intercepted by the lens. The scallops will respectively be above and below a chosen horizontal plane passing through the optical axis or respectively to the right and left of a chosen vertical plane passing through the optical axis. Naturally the plane may also be oblique, as already mentioned.

Advantageously, at least one additional reflector is associated with each scallop and disposed on the side of the scallop opposite to the optical axis in order to produce an additional beam which is not intercepted by the lens. In order to define in an equivalent fashion the position of the additional reflector or reflectors with respect to the scallop or scallops associated with them, it can be stated that these reflectors are situated on the side where the light escapes through the said scallop.

Each scallop can be situated in a horizontal or vertical or oblique plane. It is possible also to combine several types of scallop, and to have a system with, for example, a scallop in a substantially vertical plane and a scallop in a substantially horizontal plane. The two scallops can be separate or, on the other hand, be joined and thus form a single scallop, with an L or T shape for example. It is then possible to obtain an optical system also, schematically, with an L, V or T shape, and not only with a horizontal or vertical "linear" appearance.

Advantageously, the limit of the additional reflector (or at least one of them if there are several of them) on the side of the light source is such that no light is lost between the reflector R and the additional reflector, at the scallop. In order to achieve this, preferably, the additional reflector attains at least the limit of shadow created by the reflector R in the beam emitted by the light source.

The additional reflector or reflectors preferably have a complex surface. They are designed to increase the range of the light beam. Advantageously, the additional reflector or reflectors are also designed to create a cut-off of the light beam inclined to the horizontal, in particular at 15°.

The supplementary reflectors are separate from the lens, in particular vertically or horizontally according to their arrangements, by a sufficient distance to prevent the beam returned by these reflectors interfering with the lens.

The surfaces of the additional reflectors can be limited by the plane tangent to the output surface of the lens and orthogonal to the optical axis, in order not to increase the overall depth of the system.

Advantageously, at least one space created between an additional reflector and the reflector of the lens is used for fulfilling another lighting or indicating function, without increasing the overall space requirement. In particular, it is possible to install a DRL (Day Running Light) function between a top additional reflector and the top edge of the lens. The illuminating surface, in order to fulfil the DRL function, can be increased by at least part of the surface of the lens, illuminating one edge of the lens (in particular its top edge or its lateral edge depending on whether the arrangement of the reflector is of the vertical or horizontal type), using the beam created by the DRL reflector.

Advantageously, the additional functions are performed by means of simple reflectors so that all the reflectors can be produced in a single piece, which can be removed from the mould along the direction of the optical axis.

It is in particular possible to envisage, as an additional function, apart from the DRL already cited, the functions: side light, direction indicator, fog light, fixed bending lights or FBLs.

When additional light functions using light-emitting diodes are added, the said diodes are preferably disposed below a horizontal plane containing the optical axis of the light source fulfilling the dipped function, in order to be less exposed to heating.

In order to improve the light beam of a dipped headlight, in particular in the configuration with a substantially vertical scallop, an additional reflector in two parts is provided, namely an end part, giving the smallest images, essentially providing long range and the area with inclined cut-off, and a special part, closer to the optical axis, provided for spreading its images under the cut-off towards the apex of the V.

In order to optimise the value of the illumination at points whose position is determined relative to the apex of the cut-off V, or to increase the robustness of the system in terms of dazzle with respect to the relative positioning tolerances (providing the alignment of the cut-offs issuing from the various elements), a means is provided for vertically moving the light beam issuing from the square lens with respect to the beam of the additional reflectors. A lowering of the beam of the square lens is obtained by a rotation of the exit face of the lens about its top horizontal edge. This rotation can be provided by a prism added against the exit face of the lens, or by an appropriate definition of the exit face of the lens in order to obtain the same effect.

It is possible to favour the top, the bottom or the lateral part of the system in order to place the additional reflectors there. The system can have an asymmetric configuration better adapted to integration in a given headlight. The light source formed by a lamp can then be placed offset, in the direction of the additional reflectors, with respect to the square lens. Such positioning makes it possible to obtain a more closed surface in the direction opposite to that of the offset.

In order to keep sufficient range for the light beam, it is possible to provide, for the additional reflectors, surfaces which, on the favoured side, project beyond the exit plane of the lens. The depth along the optical axis of the main reflector is then greater, but this depth along a normal to the oblique exit glass of the headlight may be smaller.

The surfaces of the additional reflectors can comprise serrations delimiting facets, in particular at least one central facet and two side facets.

The invention consists, apart from the arrangements disclosed above, of a certain number of other arrangements which will be dealt with more explicitly below with regard to example embodiments described in detail with reference to the accompanying drawings, but which are in no way limiting. In these drawings:

BRIEF DESCRIPTION OF THE DRAWINGS

FIG. 9 is a schematic vertical section of a variant embodiment of the headlight with oblique exit glass, and FIG. 10 is a diagram of photometry obtained with the first headlight of the invention.

DESCRIPTION OF THE PREFERRED EMBODIMENTS

EXAMPLE 1

FIGS. 1 to 10 relate to a first example embodiment of the invention, where the general orientation of the headlight, or at least of the optical system grouping together the reflectors, the light source and the lens, is vertical. A "vertical" or "verticalised" optical system is then spoken of in the invention.

Figure 1:
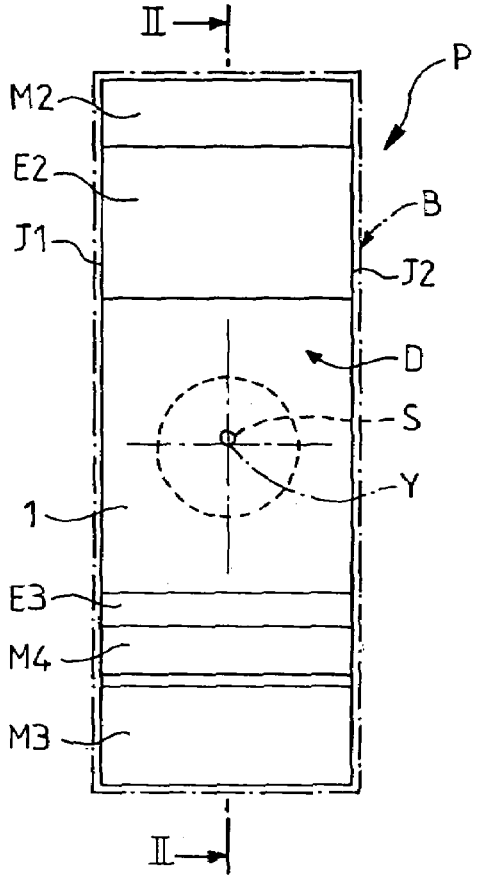
FIG. 1 is a schematic front view of a first headlight according to the invention, of the vertical orientation type.
Figure 2:
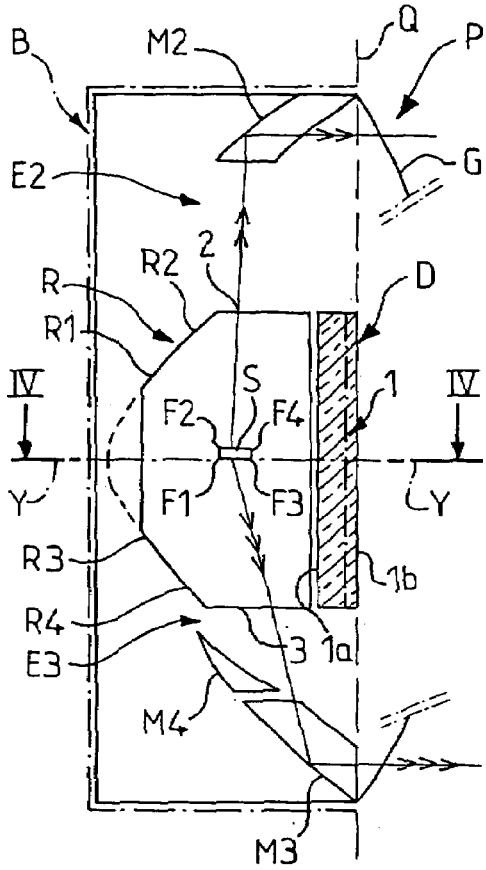
FIG. 2 is a vertical schematic section along the line II—II in FIG. 1.

Referring to FIGS. 1 and 2, a headlight P for a motor vehicle can be seen, comprising a reflector R with an optical axis Y—Y and at least one focus F1, a light source S placed close to the focus, and a transparent optical deviation element D placed in front of the reflector R.

The deviation element D consists of a square lens 1 having at least one cylindrical face 1*b* with vertical generatrices, able to provide a horizontal spread of the light, without any substantial influence in the vertical direction. A lens of this type is described in EP-A-1 243 846. In the example depicted in the drawings (FIG. 4), the entry face or rear face 1*a* of the lens 1 is flat, orthogonal to the optical axis Y—Y, whilst the front face 1*b* constitutes the cylindrical face with vertical generatrices bearing on a horizontal directing curve A. The directrix A can comprise a central part convex towards the front lying between two concave parts. The contour of the lens 1 (FIG. 1) is generally rectangular or square, but this lens could be divided according to a circular or other contour.

Advantageously, since it is the most simple, the cylindrical face 1*b* of the lens is turned towards the rear and constitutes the entry face whilst the flat face 1*a* constitutes the exit face turned towards the front. The face 1*a* can possibly be cylindrical, in particular for reasons of style.

The reflector R constitutes an essentially convergent mirror (the edges can be parabolic, and the reflector can therefore have locally non-convergent areas) whilst the lens 1 is partially divergent.

The light source S can consist of the filament of an incandescent lamp, or the arc of a gas discharge lamp.

The various elements of the headlight can be enclosed in a housing B closed at the front by a smooth glass shown diagrammatically at G (FIGS. 2 and 9). The housing is disposed around cheeks J1, J2 to which the lens 1 is fixed.

Figure 6:
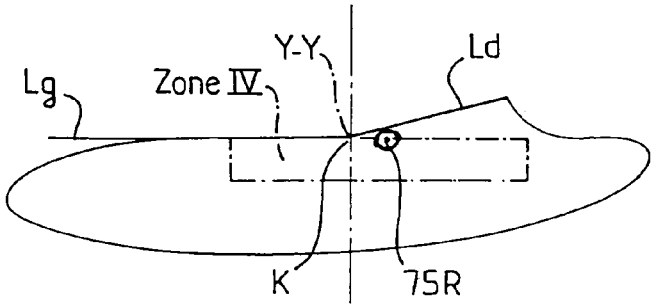
FIG. 6 is a diagram of the central area of a screen illuminated by a headlight according to the invention.

The reflector R is designed to generate a light beam delimited by a horizontal top cut-off Lg (see FIG. 6). EP-A-1 243 846 discloses a method of calculating the surface area of the reflector R. The cross-section (FIG. 4) of the reflector R through a horizontal plane passing through the optical axis Y—Y is constructed according to a given law, chosen so that the curve of the cross-section closes sufficiently around the source S in order to recover a large amount of light flux. The focal distance f0 between the point F1 and the theoretical bottom of the reflector (the rear part of this reflector is cut in order to create a passage) also makes it possible to act on the light flux recovery. The recovery is all the higher, the smaller this focal distance f0.

The wall of the reflector R comprises at least one scallop, and preferably two scallops 2, 3 situated in a horizontal plane, respectively above and below the optical axis Y—Y. The scallops 2, 3 can extend at least as far as the rear end of the filament, or of the arc, of the source S.

At least one additional reflector M2, M3 is associated with each scallop 2, 3 and is disposed on the side of the scallop opposite to the optical axis.

These additional reflectors M2, M3 are designed to collect, at least partially, the light escaping through the scallops 2, 3 and to return this light in the exit direction (parallel to the optical axis Y—Y) without its passing through the lens 1. The additional reflectors M2, M3 can be intentionally separated in the vertical direction. It is however necessary to delimit them, preferably, by the plane Q of the exit surface of the lens 1 in order not to increase the overall depth of the system in the direction of the optical axis.

The additional reflectors M2, M3 are designed to give a light beam having a long range along the optical axis Y—Y, but much less spread than that produced by the lens 1. The reflectors M2, M3 are also generally designed to give a beam situated below a cut-off line Ld (see FIG. 6) inclined to the horizontal by a given angle (according to the type of driving, on the right or left) in order to produce a dipped headlight function. By way of indication, for a European country with traffic on the right, the cut-off line Ld of the beam produced by the reflectors M2, M3 is inclined by 15° to the horizontal and rises from left to right.

The reflectors M2, M3 are of the complex surface type, in particular of the "verticalised reflector" type as taught by EP-A-0 933 585. Such a reflector extends mainly in the vertical direction and its surface is determined so as to reflect in a substantially horizontal direction, below a cut-off line, light rays coming from a source situated close to the focus.

The complex surfaces of these reflectors are adapted to transverse filaments which make it possible to reduce the height of the images used in order to produce the maximum illumination, and therefore to reduce the light which "trails" on the road. The cut-off inclined at 15° to the horizontal is then produced by shifting upwards the images naturally having an inclination of between 0° and 15°.

Having regard to the generatrix of the reflector R for the square lens 1, a strictly transverse filament substantially reduces the light flux captured by the module. It is however possible to incline it, in a horizontal plane, so as to increase the flux captured: use will then preferably be made of an axial filament lamp which is more usual and reliable than a transverse filament lamp. Thus the passage hole of the lamp and the shadow cone of its opaque end (black top) are thus moved: useful flux can remain collected, at least on one side, as far as the exit face of the mirror. The consequence on the surfaces is a change in position of the foci to be taken into account for generating the parabolic cylinders and, for the "verticalised" reflector, a change in the area to be offset in order to construct the cut-off line inclined at 15° to the horizontal.

In such a variant, a compromise can be found between the flux captured and the quantity of light which "trails" on the road.

The reflectors M2, M3 having to give a good range, it is advantageous to separate them vertically from the light source S in order to have the smallest images possible. This separation is however limited by the total height acceptable for the headlight.

When the filament of the light source is axial, or substantially axial, the surfaces of the reflectors M2, M3 have any generatrix and controlled foci, giving images turned through a desired angle about the axis of the filament and cut once again. On the other hand if the filament is transverse (the case of so-called verticalised complex surfaces), the offsetting of images is carried out.

The choice of the vertical separation and the datum of the exit plane Q to define the focal distance of the additional complex surfaces M2, M3 which, by way of non-limiting example, can be around 20 to 25 mm.

The generatrix of the surfaces of the reflectors M2, M3 is chosen so as to be almost parabolic in order to maximise the intensity of the light beam with however a sweep towards the right, with driving on the right, of the largest images, in order to create a beam of significant size limited by a cut-off at 15°.

The top reflector M2 is separated vertically from the reflector R so as to prevent the descending parts of the images coming from the reflector M2 from encountering the top edge of the lens 1 and thus creating dazzle by reflection in the glass.

The vertical spaces E2 and E3 created respectively between the reflector R and the additional reflectors M2 and M3 are advantageously used for fulfilling other functions without increasing the overall bulk of the headlight P.

Figure 3:
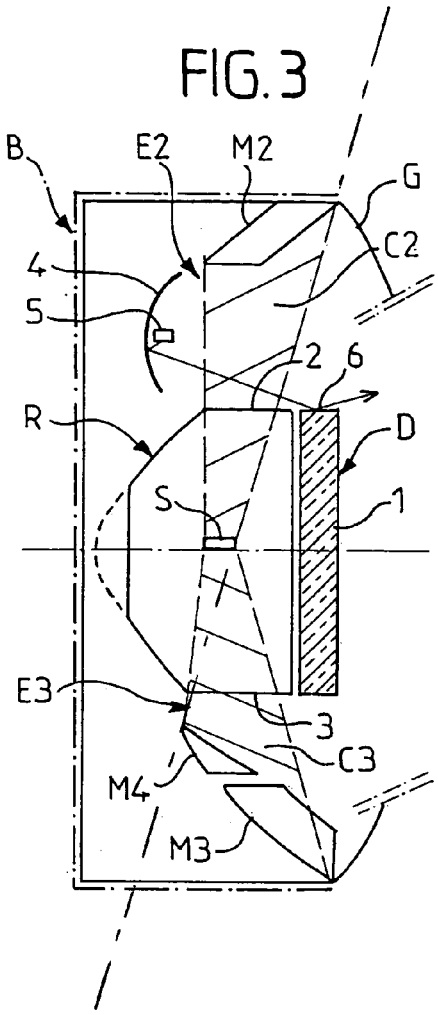
FIG. 3 is a schematic section similar to FIG. 2 of a variant comprising an additional DRL function.

In particular, as illustrated in FIG. 3, a DRL function is installed in the space E2. This function is fulfilled by means of a suitable reflector 4 fixed in the space E2 by any conventional means, not shown, and an adapted light source 5. In the case of the DRL function, a minimum illuminating surface is imposed by regulations. If necessary, the illuminating surface of the reflector R can be increased by that of the lens 1, or part of this lens, illuminating the top edge 6 of the lens by means of part of the surface of the DRL reflector 4.

Other additional functions, for example: side light, direction indicator ID, fog light AB, fixed bending lights FBL, can be installed in the spaces E2, E3. If the additional functions envisaged are fulfilled with light-emitting diodes, they are preferably placed below the dipped lamp constituting the source S, for thermal reasons.

In order not to interfere with the principal lighting function provided by the source S and the reflector R, and in order not to create dazzling in dipped mode, the reflectors of the added functions must be situated behind the light cones C2, C3 (FIG. 3) issuing from the main source S and bearing on the edges of the openings 2, 3 of the reflector R.

The additional functions such as DRL, side light or other are fulfilled advantageously by means of simple reflectors fixed to the reflector R and additional reflectors M2, M3 so that the whole can be produced in a single piece, which can be removed from the mould in the direction of the optical axis Y—Y.

The module with square lens 1 is optimised, with regard to its directing curve A, for a given depth H (FIG. 4), in terms of total flux collected and with the longest focal distance possible.

The sections of the reflector R through vertical planes consist of quasi-parabolas which are little enclosing vertically by reason of a relatively long focal distance. The section through a vertical plane passing through the optical axis Y—Y (FIG. 2) has, at the reflector R, a top part composed of two arcs R1, R2 which are quasi-parabolic, with different foci F1, F2, and at the bottom part two arcs R3, R4, quasi-parabolic with different foci F3, F4.

The light source S is shown diagrammatically in the form of a cylinder of revolution with its axis parallel to the optical axis Y—Y, situated above this axis and having its lower generatrix tangent to the optical axis.

The arc R1 is designed so that its focus F1 is situated on the optical axis Y—Y at the rear end (or close thereto) of the source S. The arc R2 is designed so that its focus F2 is situated at the top rear end (or close thereto) of the source S, that is to say slightly above the optical axis Y—Y.

The bottom arc R3 is designed so that its focus F3 is situated on the optical axis Y—Y at the front end (or close thereto) of the source S. The arc R4 is designed so that its focus F4 is situated at the top front end (or close thereto) of the source S, and therefore slightly above the axis Y—Y.

There is thus a difference in focal distance between the top part R1, R2 and the bottom part R3, R4 of the section of the reflector. The top part R1, R2 has a focal distance less than that of the bottom part R3, R4, the difference between the two focal distances corresponding to the length of the filament of the light source. By way of non-limiting example, the filament has an axial length of 4 mm, the focal distance of the top part R1, R2 is 12 mm whilst that of the bottom part R3, R4 is 16 mm. The greater the focal distance, the less substantial is a defect in positioning of the source S. The positioning tolerance of the source S is in general around 0.15 mm.

The control of the foci is provided so as to optimise the sharpness of the cut-off of the beam issuing from the square lens above the horizontal line Lg. This is obtained by means of an iterative process.

The position parameters of the lens 1 and of the various foci of the generatrix (corresponding to a section through a vertical plane) of the reflector R are chosen so as to minimise the depth. A minimum space requirement nevertheless remains imposed by the minimum distance necessary between the front end, or balloon, of the source S and the lens 1 in order to avoid thermal problems and problems of interception of the light rays.

FIG. 3 depicts an axis in a broken line, passing through the space E2 and touching the bottom edge of the reflector R: by extending this axis downwards, it can be seen that it in fact constitutes the shadow limit created by the reflector R: in this configuration, no or almost no light is "lost" at the scallop: all the light escaping from R through the scallop is recovered by the reflector M4.

Figure 5:
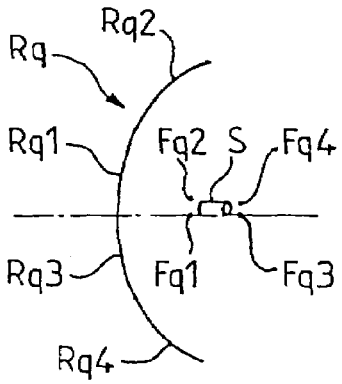
FIG. 5 is a section along the line V—V in FIG. 4.
Figure 4:
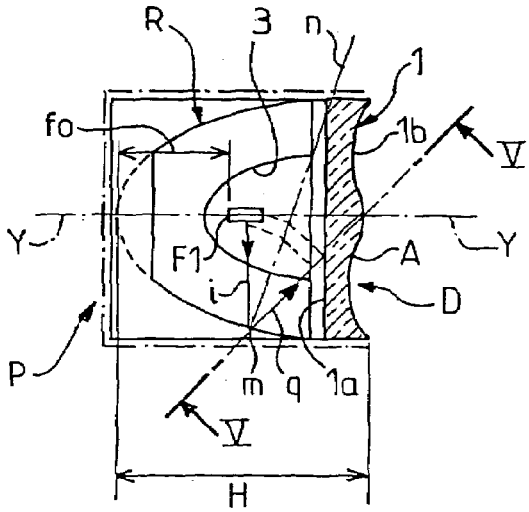
FIG. 4 is a schematic section along the line IV—IV in FIG. 2.

One example of control of the foci of the vertical sections of the reflector R is given with reference to FIGS. 4 and 5. In FIG. 4 a light ray i is considered, coming from the centre of the source S, falling on the reflector R at a point m on the horizontal section containing the optical axis. The normal to the surface of the reflector R at point m is represented by the straight line n. The ray i is reflected in the direction q symmetrical with the ray i with respect to n. The section of the reflector R through a vertical plane passing through the direction q and corresponding to the section V—V is illustrated in FIG. 5 by the curve Rq, which is composed of four different arcs of a curve Rq1, Rq2, Rq3 and Rq4. A first orthogonal projection of the source S on the vertical plane passing through the direction n is considered and, from this first projection, a second orthogonal projection on the vertical plane passing through the direction q. In the plane passing through q, a representation of the source S whose circular ends are transformed into ellipses is obtained. The arcs Rq1 and Rq2 are designed to have foci Fq1 and Fq2 behind the rear end of this projection of the source S, respectively at the vertical level of the bottom and top generatrices. The two bottom arcs Rq3 and Rq4 are designed to have foci Fq3, Fq4 in front of the front end of the source S, and at the same vertical level as Fq1 and Fq2.

FIG. 6 is a simplified diagram of a central area illuminated by a dipped headlight according to the invention, on a screen orthogonal to the optical axis placed at a given distance (in general 25 metres) from the headlight. The beam is cut above a V-shaped line comprising a horizontal left-hand arm Lg and a right-hand arm Ld inclined to the horizontal by 15° and rising from left to right. The intersection of the two arms defines the apex K of the V.

The area situated below the horizontal line Lg, on each side of the apex K, is defined as the "area IV" by a standard. The illumination in this area IV must attain a predetermined minimum level.

To improve the light beam and satisfy the lighting required on the left in the area IV, the bottom additional reflector comprises two parts: an end part corresponding to the reflector M3 described previously, giving the smallest images, and a top part consisting of a special surface formed by another additional reflector M4 (FIGS. 2 and 3) designed to spread the images of the source under the cut-off Lg in the area IV, as far as an angle of 6° between the optical axis and the direction passing through the centre of the headlight and the left-hand extreme edge of the area IV.

This additional reflector M4 is preferably disposed at the bottom part since the surface of the reflector R is more open in its bottom part, whose focal distance is greater, for a positioning of the lamp S at the centre.

A characteristic point, designated "75R" according to a standard, is situated slightly to the right of the apex K according to given coordinates.

Figure 7:
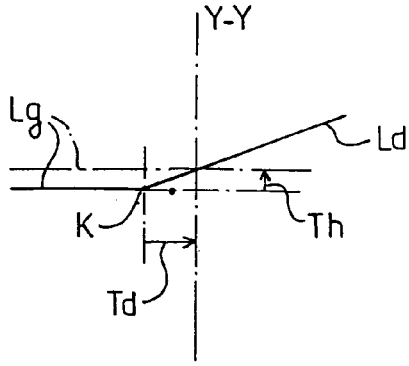
FIG. 7 is a diagram illustrating the relative movement of the horizontal cut-off with respect to the inclined cut-off.

In order to optimise the value of the illumination at the point 75R, a movement of the light beam issuing from the square lens 1 is provided with respect to the light beam issuing from the additional reflectors M2, M3. For this purpose, the light beam of the square lens 1 is lowered vertically with respect to the beam of the additional reflectors M2, M3. The right-hand arm Ld of the cut-off V does not move since it results from the additional reflectors. On the other hand, the horizontal arm Lg due to the beam of the square lens 1 is moved downwards as illustrated in FIG. 7. The apex K of the cut-off V moves on the line Ld towards the bottom and towards the left, as illustrated in FIG. 7.

In order to return the apex K to the optical axis Y—Y, an adjustment is made consisting of moving the beam of the additional headlights to the right (arrow Td) and upwards (arrow Th), as illustrated in FIG. 7.

In one example embodiment, the beam of the square lens 1 has been lowered by 0.33°. This amounts, after adjustment, to moving the beam by 2% (the tangent of the movement angle) to the right and by 0.5% (the tangent of the movement angle) upwards.

Figure 8:
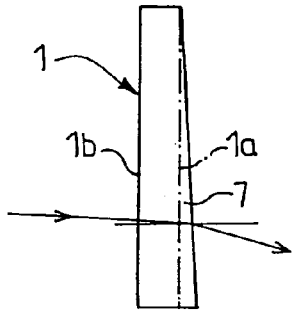
FIG. 8 is a schematic section, through a vertical plane parallel to the optical axis, of the square lens equipped with a prism on its exit face.

As illustrated in FIG. 8, the downward movement of the beam emerging from the square lens 1 can be provided by a rotation of the exit face of the lens about a horizontal axis formed by its top edge. The exit face of the lens is then preferably formed by the flat face 1*a*. The rotation of the exit face is obtained by adding a prism 7, one face of which is pressed against the face 1*a*. The edge of the prism is applied against the top edge of the exit face of the lens whilst the base is at the bottom part. The prism 7 can be produced in the same way as the lens in order to have the same refractive index. The prism 7 may not physically exist: there is simply a lens with a flat face forming with the "vertical" an appropriate angle, the "vertical" having to be understood as being the axis of the generatrices of the other face of the lens.

In this configuration, it is necessary to tilt the beam of the special surface M4, when such exists, by the same angle as that by which the beam of the square lens 1 has been tilted. This can be obtained by making the base surface M4 turn about a horizontal axis passing through its bottom focus.

It is possible to favour the top or bottom of the system in order to place the additional reflectors there. It is even possible to envisage having additional reflectors solely at the top or at the bottom, since an asymmetric configuration may be better adapted to integration in a given headlight. In order to preserve a high captured light flux, it is then desirable to place the lamp S so as to be offset, in the direction of the additional reflectors, with respect to the square lens 1. This is because such a positioning makes it possible to obtain a surface which is more closed in the direction opposite to that of the offset.

In order to preserve satisfactory range of the light beam, it is also desirable to allow the surfaces of the additional reflectors such as M3 (FIG. 9) to project beyond the exit plane Q of the lens, which makes it possible to have small images. The enlargement of the reflector M3 downwards is however technically limited by the interception of the light rays coming from the source S by any opaque end 8 (black top) or by the bottom part 9 of the lens 1.

The depth H1 along the optical axis is then greater but, if the generally oblique exit glass G is considered, the depth H2 in a direction perpendicular to the mean direction of the glass G is smaller.

Finally, it may be advantageous to place the special surface M4 on one side and all the other additional surfaces forming the additional reflectors on the other side.

The cheeks J1, J2 (FIG. 1) do not pose any problem for the angle of the beam since the width of the beam is obtained by the lens 1, whilst the light beams issuing from the other parts such as M2, M3 are narrow. In addition, the separated images designed for extending the inclined cut-off line Ld come from the central area of the additional reflectors. The cheeks J1, J2 do not therefore have any optical role.

The thermal problems of the square lens module reflectors are reduced since the reflector R is open above and below the lamp by virtue of the scallops 2, 3.

The surfaces of the additional reflectors M2, M3 can have serrations, repeating the extruded line of the lens 1.

In the case of an asymmetric system, namely square-lens module 1 towards the top, lamp S possibly offset towards the bottom of the lens, a single additional reflector below the lens module, it is advantageous to use for the additional reflector a reflector of the "verticalised" type particularly adapted to this geometry.

FIG. 10 is a diagram of the photometry of the light beam obtained, with an outline of isolux curves (points having the same illumination). The central curve Im is that of high illumination, for example 48 lux. The maximum illumination point, for example 68 lux, is situated within this curve. The outside curve If corresponds to low illumination, for example 0.4 lux. The intermediate curves correspond to illuminations decreasing from the centre towards the outside. The horizontal graduations expressed in % correspond to the tangent of the angle formed between the optical axis and the horizontal direction passing through the centre of the headlight and the point marked by the graduation on the screen. For vertical graduations, it is a case of the tangent of the angle formed between the horizontal plane passing through the optical axis and the direction passing through the centre of the headlight and the point marked by the graduation on the screen. Cut-off lines Lg and Ld are found.

A headlight according to the invention allows high captured flux and therefore good efficiency. The depth of the headlight is limited. All the reflectors, including the reflectors for additional functions, DRL or other, can be removed from the mould in one go without any need for a slide for the moulding. In order to produce a dipped beam, the headlight does not have any shield which absorbs light.

It is possible to use the top part or the bottom part for the fitting of the additional reflectors according to the possibilities of integration and the style required.

EXAMPLE 2

Figure 11:
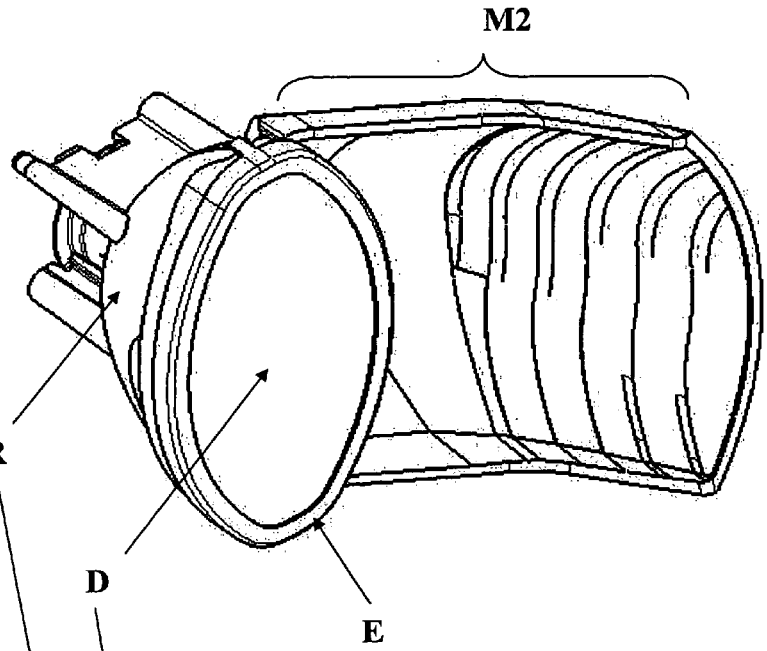
FIG. 11 is a schematic side view of a second headlight according to the invention, of the type with horizontal orientation.
Figure 12:
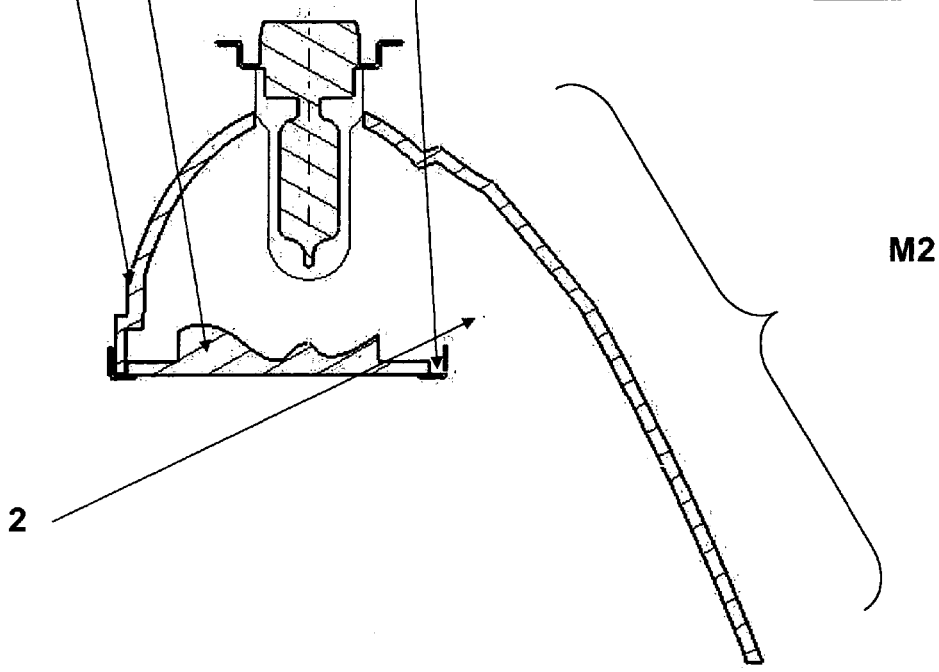
FIG. 12 is a schematic view through a horizontal section of the second headlight according to FIG. 11.
Figure 13:
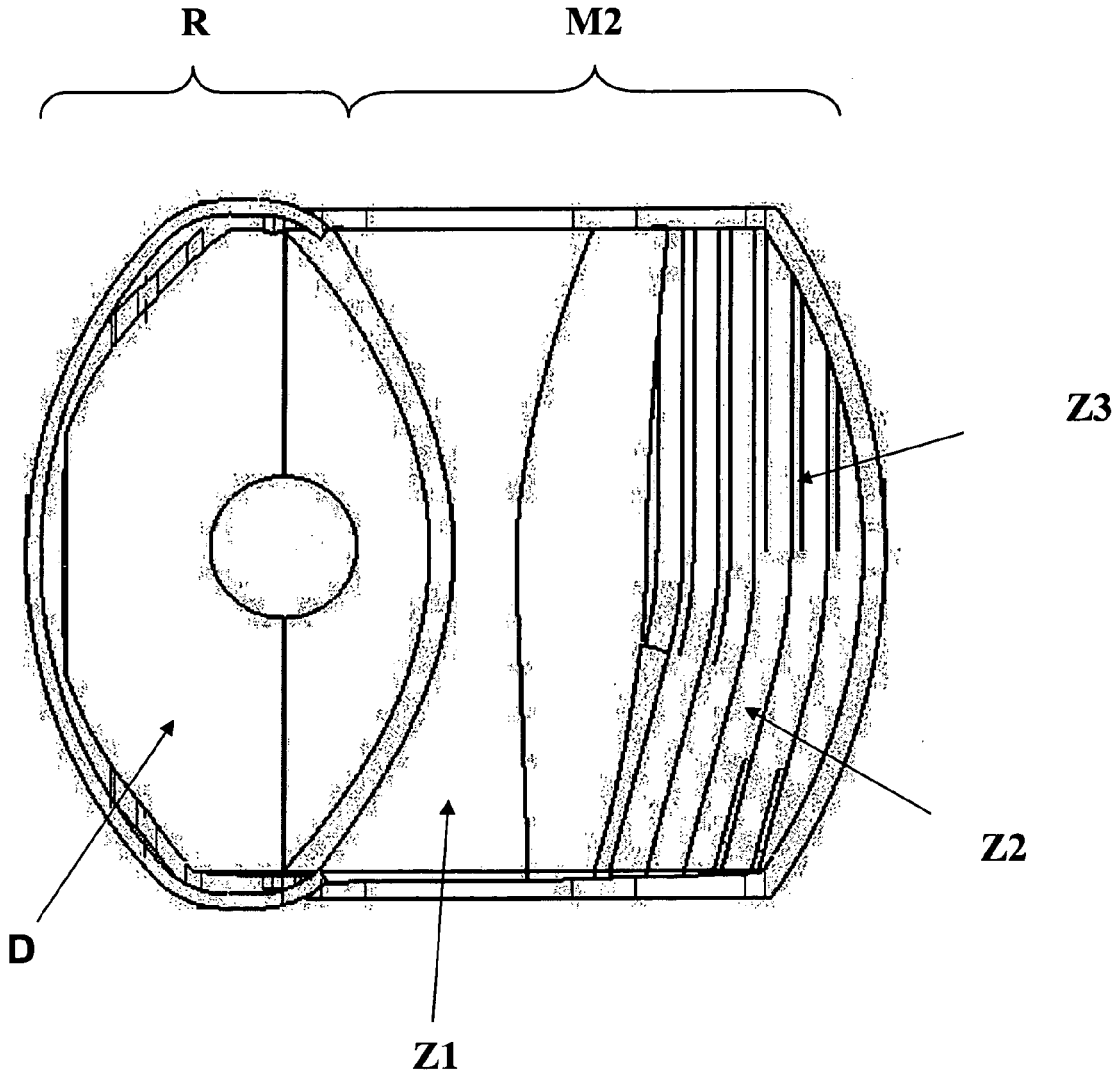
FIG. 13 is a schematic front view of the second headlight according to FIG. 11 (dipped headlight of the driving on the right type).

This example relates to FIGS. 11 to 13 and concerns a second type of headlight, where the general orientation of the optical system is now horizontal. The elements common with the first example will not be detailed again, and the references of the drawings will be identical to those depicted in FIGS. 1 to 10 for designating the same elements. FIG. 11 is a perspective view of the optical system: the reflector R, the lens D whose contours are here chosen so as to be substantially oval, are found once again. And the reflector M2. The lens is fixed to the reflector R by an element E which entirely grips its periphery. Alternatively, this fixing element E can surround only part of the periphery of the lens, either for aesthetic reasons, or to provide, in particular in the top part, one or more openings providing better ventilation, and therefore less heating of the optical system.

FIG. 12, which is a view in horizontal section, depicts the axial-filament lamp S, the "square" lens D here ogival in shape, and the scallop 2. Contrary to Example 1, there is therefore here a reflector M2 disposed horizontally, and a scallop 2 which is situated substantially in a vertical orientation. The reflector M2 is of the complex surface type and makes it possible to obtain a dipped beam with cut-off at 15°. FIG. 13, which is a front view, shows that the reflector M2 can be schematically broken down into three areas: the area Z1, preferably with no serrations, and the areas Z2 and Z3: the area Z2, which is disposed in the bottom right-hand part of the reflector M2, is the area dedicated to obtaining the 15° cut-off, the area Z3, which is disposed above the area Z1, contributes to the range of the beam, with a cut-off of the horizontal type. In this example, the areas Z2 and Z3 are provided with serrations, but this is not obligatory.

EXAMPLE 3

Figure 14:
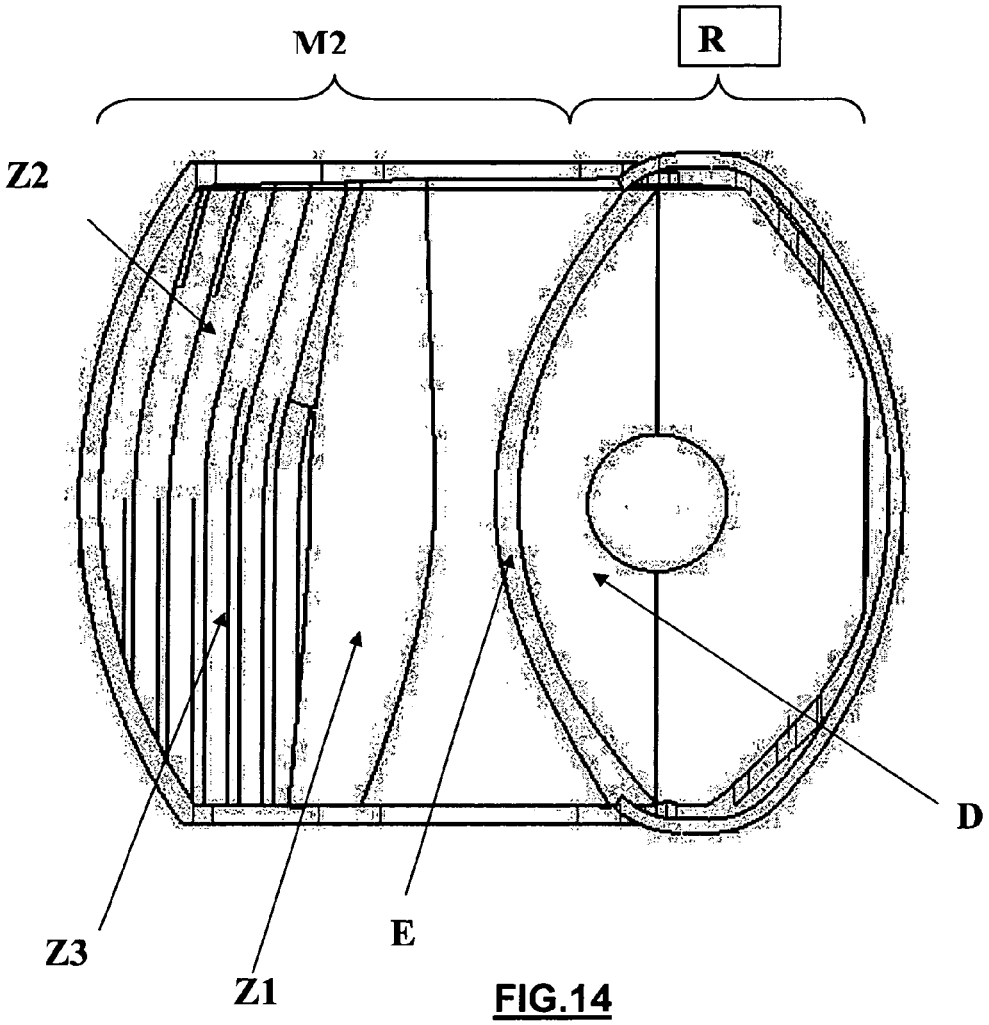
FIG. 14 is a schematic front view of a third headlight of the horizontal orientation type, in the dipped headlight mode of the driving on the right type, but with a relative positioning of the reflector R with respect to the additional reflector M2 which is reversed compared with the configuration according to FIG. 13.

This example relates to FIG. 14, and is close in its design to Example 2: it is also a case of an optical system of the horizontal type, with the same lens as in Example 2. The only difference lies in the relative positioning of the reflector R with respect to the reflector M2: the arrangement of the reflector M2 with respect to the lens D is reversed with respect to the vertical, and the area Z2 dedicated to form the cut-off at 15° is now in the top left-hand part of the reflector M2, above the area Z3 contributing to the range of the beam.

For this example in particular, it should be noted that it is also possible to obtain dipped headlights of the driving on the left type, that is to say with V-shaped cut-offs at 15° in inverted, by effecting a symmetry with respect to a vertical plane containing the optical axis of the modules according in particular to FIGS. 13 and 14, the scallop then being situated on the opposite side.

EXAMPLE 4

Figure 15:
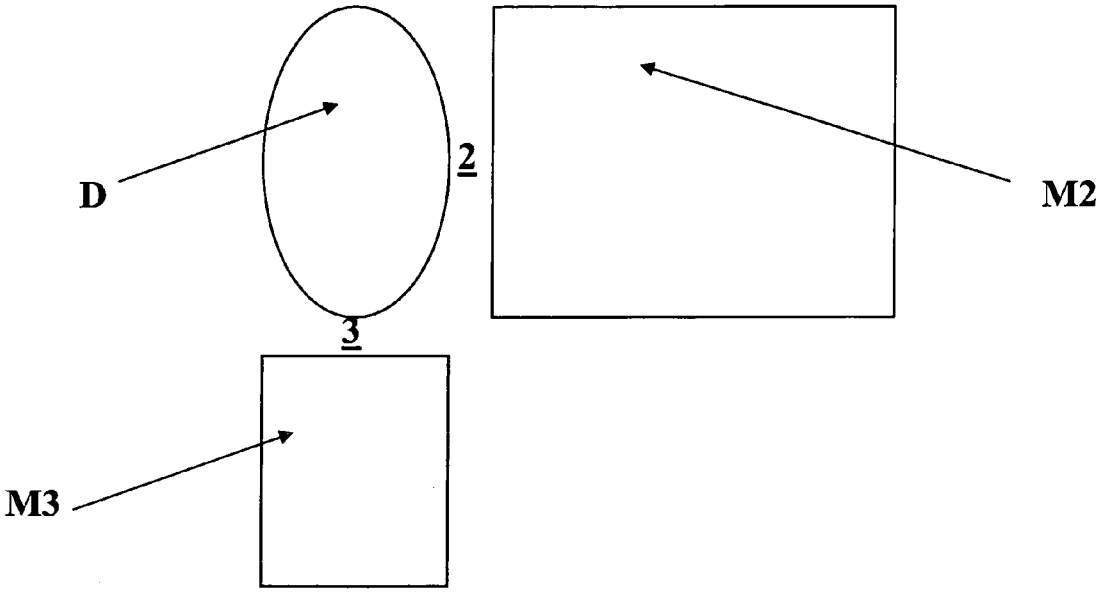
FIG. 15 is an extremely schematic front view of a fourth headlight with an L-shaped orientation.

This example relates to the highly schematic FIG. 15, which is a front view of a fourth type of headlight according to the invention: it is a case of a headlight in the form of an inverted L, where the lens D and its reflector R are associated with two additional reflectors M2 and M3, the reflector R defining two scallops 2, 3 so that part of the light emitted by the light source can respectively escape to the reflectors M2 and M3. The reflectors M1, M2 are disposed perpendicular with respect to each other, and the two scallops 2, 3 are also perpendicular with respect to each other, and joined in a single opening. They could also be separate. It is also possible to modify this example headlight in order to have non-inverted L shapes, T shapes, oblique shapes etc.

In these various examples, it should be noted that the invention permits quantities of variants, and allows forms of optical systems which are highly varied in their general appearance.

It is also possible to have, in a horizontal version, the additional reflectors disposed on each side of the square lens, in a similar fashion to the configuration according to FIG. 1 for example, but turned through 90°.

What is claimed is:

1. A headlight for a motor vehicle comprising:

a reflector having a wall, an optical axis and at least one focus;

a light source disposed near said at least one focus, and a transparent optical deviation element disposed in front of a portion of the reflector, for providing a substantially horizontal spread of light, wherein the reflector includes at least one arcuate portion on at least one side of a plane passing through the optical axis of the reflector, at least one additional reflector being disposed adjacent to and on a side of the at least one arcuate portion opposite the optical axis, for collecting at least part of the light from the source passing through the at least one arcuate portion so as to produce at least one light beam is not intercepted by the transparent optical deviation element.

2. The headlight according to claim 1, wherein the at least one arcuate portion is disposed on a plane that is vertical, horizontal or oblique with respect to the optical axis.

3. A headlight according to claim 1, wherein the transparent optical deviation element is optimized in terms of total flux collected, with regard to its horizontal directing curve, for a given depth of the headlight and with a longest possible focal length.

4. A headlight according to claim 1, wherein the transparent optical deviation element is optimized in terms of total flux collected, with regard to a height of its vertical section, for a given depth of the headlight and with a longest possible focal length, when the at least one arcuate portion is disposed on one side of a vertical or oblique plane passing through the optical axis.

5. A headlight according to claim 1, wherein the at least one arcuate portion comprises two arcuate portions disposed on each side of a plane passing through the optical axis.

6. A headlight according to claim 1, wherein the at least one arcuate portion is situated in a plane which is horizontal, vertical or oblique with respect to the vertical.

7. A headlight according to claim 1, wherein the at least one additional reflector has a complex surface for increasing the range of the light beam.

8. A headlight according to claim 1, wherein the at least one additional reflector is vertically or horizontally separated from the transparent optical deviation element by a distance sufficient to prevent the light reflected by said at least one additional reflector from interfering with the transparent optical deviation element.

9. A headlight according to claim 8, wherein the transparent optical deviation element is illuminated at an edge thereof by light reflected by said at least one additional reflector.

10. Headlight according to claim 1, wherein surfaces of the at least one additional reflector are limited by a plane tangent to an exit surface of the optical deviation element and orthogonal to the optical axis.

11. Headlight according to claim 1, wherein the at least one additional reflector reaches at least a shadow limit created by the reflector in the light emitted by the light source.

12. A vehicle equipped with at least one headlight according to claim 1.

13. A headlight for a motor vehicle comprising:

a reflector having a wall, an optical axis and at least one focus;

a light source disposed near said at least one focus and a transparent optical deviation element disposed in front of a portion of the reflector for providing a substantially horizontal spread of light, wherein the reflector includes at least one arcuate portion on at least one side of a plane passing through the optical axis of the reflector, at least one additional reflector being disposed adjacent to and on a side of the at least one arcuate portion opposite the optical axis, for collecting at least part of the light from the source passing through the at least one arcuate portion so as to produce at least one light beam is not intercepted by the transparent optical deviation element, and wherein the at least one additional reflector includes a cut-off of light inclined to 15° to the horizontal.

14. A headlight for a motor vehicle comprising:

a reflector having a wall, an optical axis and at least one focus;

a light source disposed near said at least one focus and a transparent optical deviation element disposed in front of a portion of the reflector for providing a substantially horizontal spread of light, wherein the reflector includes at least one arcuate portion on at least one side of a plane passing through the optical axis of the reflector, at least one additional reflector being disposed adjacent to and on a side of the at least one arcuate portion opposite the optical axis, for collecting at least part of the light from the source passing through the at least one arcuate portion so as to produce at least one light beam is not intercepted by the transparent optical deviation element, and wherein space created between the at least one additional reflector and a reflector of the transparent optical deviation element is used for additional lighting or indicating function.

15. A headlight according to claim 14, wherein of the said additional lighting or indicating function is a day running light.

16. A headlight according to claim 14, wherein the reflector of the transparent optical deviation element is a single piece and is removable in the direction of the optical axis.

17. A headlight according to claim 16, wherein a lowering of the light through the optical deviation element is provided by a prism added against an exit face of the optical deviation element.

18. A headlight for a motor vehicle comprising:

a reflector having a wall, an optical axis and at least one focus;

a light source disposed near said at least one focus and a transparent optical deviation element disposed in front of a portion of the reflector for providing a substantially horizontal spread of light, wherein the reflector includes at least one arcuate portion on at least one side of a plane passing through the optical axis of the reflector, at least one additional reflector being disposed adjacent to and on a side of the at least one arcuate portion opposite the optical axis, for collecting at least part of the light from the source passing through the at least one arcuate portion so as to produce at least one light beam is not intercepted by the transparent optical deviation element, and an additional two-part reflector for providing a long range and an area with an inclined cut-off, and a special part, closer to the optical axis, designed to spread its images below the cut-off towards the apex of the V-shaped cut-off, in particular when the at least one arcuate portion is in a horizontal or oblique plane.

19. A headlight according to claim 18, further includes a means for vertically moving the light beam issuing from the square lens with respect to the light reflected by the at least one additional reflector.

20. A headlight for a motor vehicle comprising:

a reflector having a wall, an optical axis and at least one focus;

a light source disposed near said at least one focus and a transparent optical deviation element disposed in front of a portion of the reflector for providing a substantially horizontal spread of light, wherein the reflector includes at least one arcuate portion on at least one side of a plane passing through the optical axis of the reflector, at least one additional reflector being disposed adjacent to and on a side of the at least one arcuate portion opposite the optical axis, for collecting at least part of the light from the source passing through the at least one arcuate portion so as to produce at least one light beam is not intercepted by the transparent optical deviation element, and an oblique glass having reflecting surfaces which project beyond an exit plane of the optical deviation element.

* * * * *